US006102299A

United States Patent [19]

Pace et al.

[11] Patent Number: 6,102,299

[45] Date of Patent: Aug. 15, 2000

[54] FUEL INJECTOR WITH IMPINGING JET ATOMIZER

[75] Inventors: Jeff Pace, Newport News; Vernon R. Warner, Wicomico, both of Va.

[73] Assignee: Siemens Automotive Corporation, Auburn Hills, Mich.

[21] Appl. No.: 09/216,425

[22] Filed: Dec. 18, 1998

[51] Int. Cl.[7] ..... F02M 61/10

[52] U.S. Cl. ..... 239/5; 239/533.11; 239/533.12; 239/553.3; 239/585.5; 239/590.3; 239/596

[58] Field of Search ..... 239/5, 426, 434, 239/461, 533.2, 533.11, 533.12, 553, 553.3, 585.1, 585.4, 585.5, 590, 590.3, 596

[56] References Cited

U.S. PATENT DOCUMENTS

| | | | |
|---|---|---|---|
| 4,907,748 | 3/1990 | Gardner et al. | 239/590.3 X |
| 5,244,154 | 9/1993 | Buchholz et al. | 239/590.3 |
| 5,285,970 | 2/1994 | Maier et al. | 239/533.12 |
| 5,449,114 | 9/1995 | Wells et al. | 239/596 X |
| 5,484,108 | 1/1996 | Nally | 239/585.4 X |
| 5,553,790 | 9/1996 | Findler et al. | 239/596 X |
| 5,570,841 | 11/1996 | Pace et al. | 239/533.12 X |
| 5,636,796 | 6/1997 | Oguma | 239/596 X |
| 5,685,491 | 11/1997 | Marks et al. | 239/533.12 |
| 5,762,272 | 6/1998 | Tani et al. | 239/596 X |
| 5,772,124 | 6/1998 | Tamaki et al. | 239/533.12 |

*Primary Examiner*—Andres Kashnikow
*Assistant Examiner*—Steven J. Ganey

[57] ABSTRACT

An improved atomization fuel injector for an internal combustion engine includes an armature assembly including an injector needle reciprocable between a closed position and an open position; a needle seat for receiving the injector needle in the closed position, the needle seat including a central opening therethrough; an exit orifice disk disposed downstream of the needle seat; and an impinging jet atomizer disposed upstream of the exit orifice disk. A method of improving atomization of fuel in fuel injectors includes providing a fuel injector; adding fuel to the fuel injector; passing the fuel through a central opening in a seat of the fuel injector; separating the fuel into at least two channels; and directing at least two channels of fuel towards one another such that the channels of fuel collide with each other.

21 Claims, 3 Drawing Sheets

FUEL INJECTOR WITH IMPINGING JET ATOMIZER

BACKGROUND OF THE INVENTION

The present invention relates in general to electromagnetic fuel injectors for internal combustion engines and, in particular, to fuel injectors with an impinging jet atomizer.

Increasingly stringent exhaust emission standards have driven the automotive industry to discover ways of achieving more complete combustion and thereby lower emissions. One way of achieving more complete combustion is by using fuel injectors with improved fuel atomization.

Fuel injectors typically comprise an electromagnetically actuated needle valve disposed in a fuel volume. The needle valve is reciprocated axially within the fuel volume in response to energization and deenergization of an actuator to selectively open and close a flow path through the fuel injector. Particularly, the valve body or housing defining the fuel volume has an aperture or orifice at one end forming a seat for the end of the needle valve whereby its reciprocating motion enables an intermittent flow of fuel through the orifice. Typically, the fuel emitted from a fuel injector is atomized downstream of the orifice to provide the necessary fuel/air mixture in the combustion chamber of the engine.

SUMMARY OF THE INVENTION

It is an object of the present invention to provide a fuel injector with improved atomization.

This and other objects of the invention are achieved by a fuel injector for an internal combustion engine comprising an armature assembly including an injector needle reciprocable between a closed position and an open position; a needle seat for receiving the injector needle in the closed position, the needle seat including a central opening therethrough; an exit orifice disk disposed downstream of the needle seat; and an impinging jet atomizer disposed upstream of the discharge orifice disk.

Preferably, the bottom of the needle seat includes a counterbore having a diameter larger than the diameter of the central opening of the needle seat.

The impinging jet atomizer includes a feed disk defining at least two openings, the feed disk being disposed downstream from the counterbore in the bottom of the needle seat. The impinging jet atomizer also includes a nozzle disk disposed downstream of the feed disk. The nozzle disk includes at least two openings aligned with the at least two openings in the feed disk, for receiving fuel from the feed disk, and a passageway connecting the openings in the nozzle disk such that at least two separate channels of fuel flow from the openings in the feed disk to the openings in the nozzle disk and through the passageway to impinge on one another.

Preferably, the passageway in the nozzle disk includes at least two nozzles converging from the openings in the nozzle disk to a center of the passageway.

In one embodiment, the feed disk includes a downward dimple and/or the exit orifice disk includes an upward dimple thereby creating nozzles which converge in the injector axial direction.

Another aspect of the invention is a method of improving atomization of fuel in fuel injectors comprising providing a fuel injector; adding fuel to the fuel injector; passing the fuel through a central opening in a seat of the fuel injector; separating the fuel into at least two channels; and directing the at least two channels of fuel towards one another such that the channels of fuel collide with each other.

Further objects, advantages and features of the invention will become apparent from the following detailed description taken in conjunction with the accompanying drawing.

BRIEF DESCRIPTION OF THE DRAWING

The accompanying drawings, which are incorporated herein and constitute part of this specification, illustrate presently preferred embodiments of the invention, and, together with a general description given above and the detailed description of the preferred embodiments given below, serve to explain the principles of the invention.

DETAILED DESCRIPTION OF THE PREFERRED EMBODIMENTS

In the following detailed description, certain specific terminology will be employed for the sake of clarity and a particular exemplary embodiment described, but it is to be understood that the same is not intended to be limiting and should not be so construed inasmuch as the invention is capable of taking many forms within the scope of the appended claims.

The present invention is an enhanced atomizer modification for fuel injectors. The invention utilizes the pressure energy of the fuel to create several fluid jets, which then collide or impinge with each other. The colliding fluid elements create highly disturbed flow conditions, leading to improved atomization. The resulting spray also has less kinetic energy and a lower penetration velocity, because there is less energy available after the collision process.

Figure 2:
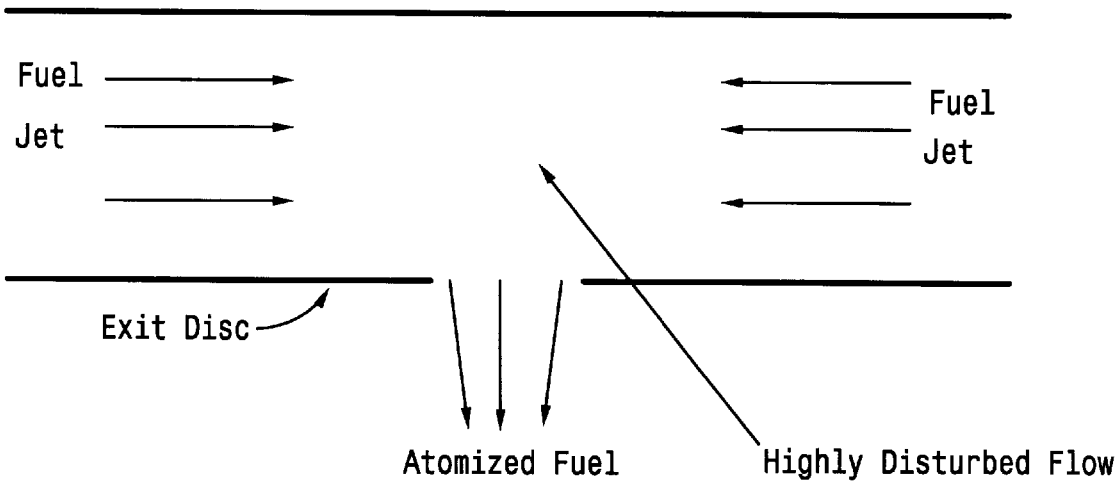
FIG. 2 is a schematic illustration of the present invention.

FIG. 2 schematically illustrates the invention, in which two fuel jets are shown colliding. The degree of fluid disturbance, and hence the level of atomization, can be controlled by varying the collision velocity of the fuel jet(s). If the jets are moving very slowly, there will be little disturbance of the flow and poor atomization. To maximize the disturbance level, a converging nozzle arrangement may be used. The nozzles may converge in the injector axial direction, the injector radial direction or both the axial and radial directions. As the fuel moves through a converging nozzle, the flow accelerates.

In general, a fuel injector includes a housing assembly which mounts a coil assembly and an armature coupled to a needle valve (needle). Surrounding the needle is a housing defining a fuel volume in communication with a fuel flow passage through the armature. At the lower end of the housing is a needle seat defining a central opening through which fuel is ejected from the fuel injector into the engine. The coil and armature cooperate to open and close the central opening by periodic axial movement of the needle within the fuel volume.

Figure 1:
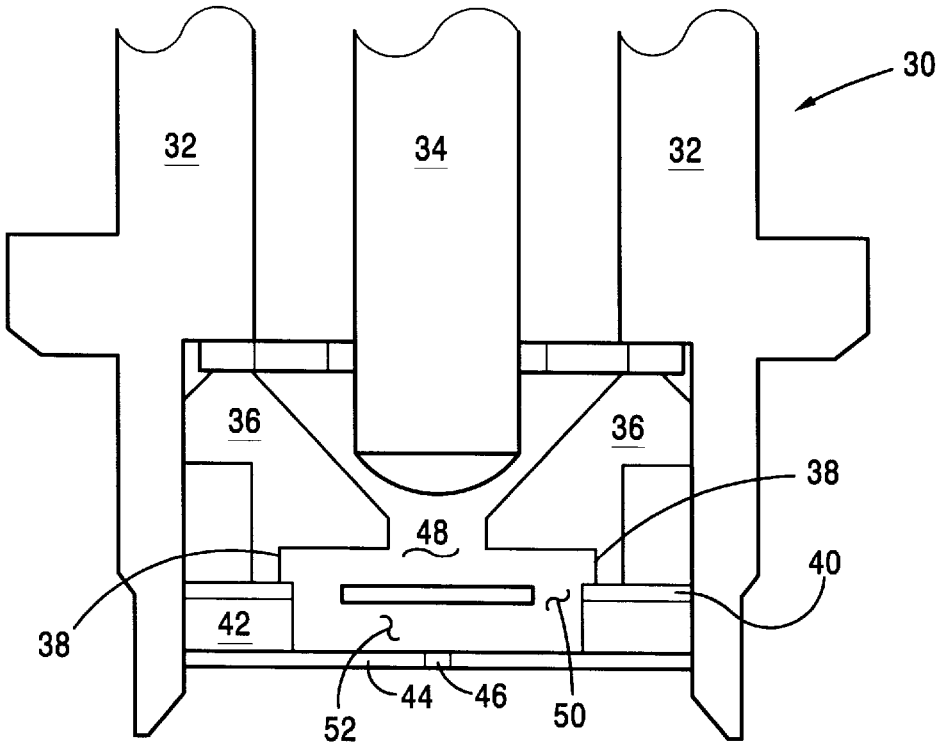
FIG. 1 is a cutaway side view of the bottom portion of one embodiment of a fuel injector according to the present invention.

FIG. 1 is a cutaway side view of the bottom portion of one embodiment of a fuel injector 30 according to the present invention. The fuel injector 30 includes a housing 32 and a needle valve 34 which is received by a seat 36. The seat 36 includes a central opening 48 through which fuel flows when the needle valve 34 is lifted from the seat 36. The seat 36 includes a counterbore 38 downstream of the central opening 48. The counterbore 38 is larger in diameter than the central opening 48.

Downstream of the counterbore 38 is a feed disk 40 followed by a nozzle disk 42 and then an exit orifice disk 44. The exit orifice disk 44 includes at least one opening 46 through which fuel exits the injector 30. The feed disk 40 includes openings 50 through which fuel flows from the counterbore 38 to the nozzle disk 42. The nozzle disk 42 includes a passageway 52 through which fuel flows towards the opening or openings 46 in the exit orifice disk 44.

Figure 4:
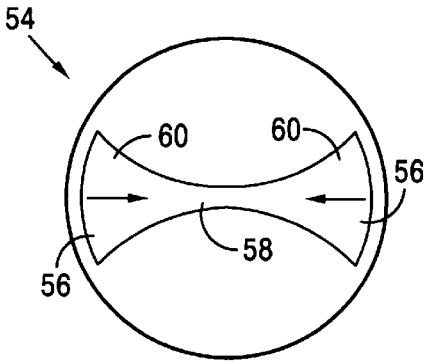
FIG. 4 is a top view of a nozzle disk.
Figure 5:
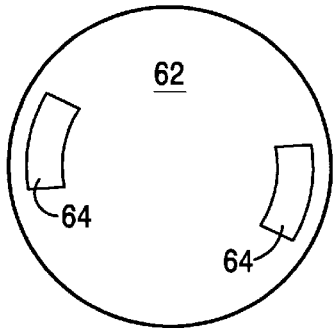
FIG. 5 is a top view of a feed disk.
Figure 8:
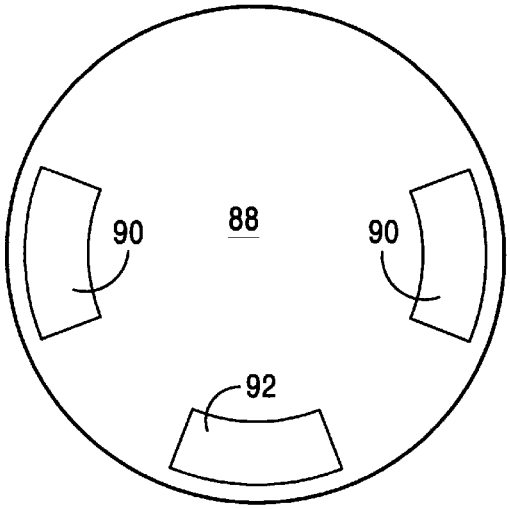
FIG. 8 is a top view of a feed disk.
Figure 9:
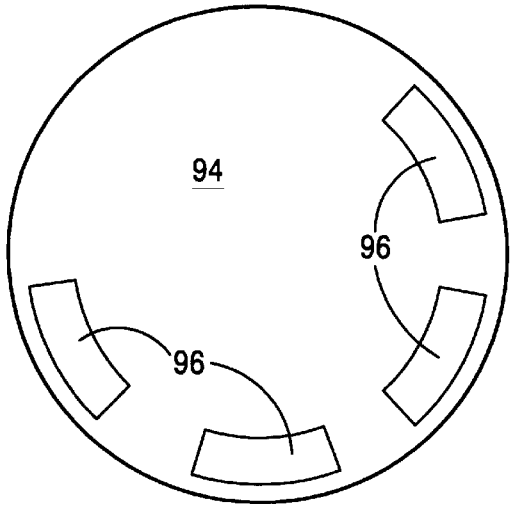
FIG. 9 is a top view of a feed disk.

The feed disk 40 and nozzle disk 42 may be punched from materials such as stainless steel, plastic or any other material which is not reactive with the fuel. The feed disk 40 and nozzle disk 42 are wedged between the exit orifice disk 44 and the seat 36. FIGS. 5, 8, and 9 show variations of the feed disk 40. FIGS. 4, 6, 7, and 10 show variations of the nozzle disk 42.

Figure 6:
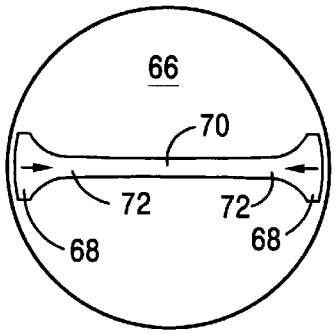
FIG. 6 is a top view of a nozzle disk.

FIG. 5 shows a feed disk 62 having two openings 64. The feed disk 62 would be used with a nozzle disk as shown in FIGS. 4 or 6. In FIG. 4, the nozzle disk 54 includes openings 56 and a passageway 58. The openings 56 are aligned beneath the openings 64 in the feed disk 62. The openings 56 lead into converging nozzles 60. Two channels of fuel indicated by the arrows in FIG. 4 accelerate towards one another and collide in the passageway 58 which is above the opening or openings 46 in the exit orifice disk 44. As a result of the collision in the passageway 58, the fuel is efficiently atomized.

FIG. 6 shows a nozzle disk 66 for use with the feed disk 62 of FIG. 5. The nozzle disk 66 includes openings 68 aligned under the openings 64 in feed disk 62. The openings 68 lead into converging nozzles 72 which meet in passageway 70 in a manner similar to that described for the nozzle disk 54 of FIG. 4. The arrows in FIG. 6 indicate the flow direction of the two fuel channels.

FIG. 8 shows a feed disk 88 having two openings 90 and an opening 92. The feed disk 88 of FIG. 8 is used with the nozzle disk 74 shown in FIG. 7. The openings 90 in the feed disk 88 are located above the openings 76 in nozzle disk 74 and the opening 92 in feed disk 88 is located above the opening 78 in nozzle disk 74. The three small arrows in the openings 76, 78 in nozzle disk 74 indicate the flow of three distinct fuel channels. Openings 76 lead into converging nozzles 84. Opening 78 leads into converging nozzle 86. Nozzles 84 and 86 meet in passageways 80, 82. The areas of the two nozzles 84 may be identical while the area of nozzle 86 may be larger. Such a construction would lead to a skewed or biased spray of fuel out of the exit orifice disk opening 46, as shown by the arrow 75 in FIG. 7.

Figure 10:
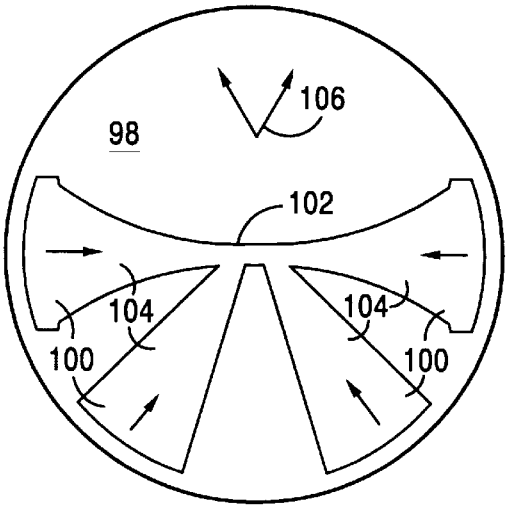
FIG. 10 is a top view of a nozzle disk.

FIG. 9 shows a feed disk 94 having four openings 96 suitable for use with the nozzle disk 98 shown in FIG. 10. The nozzle disk 98 includes openings 100 which are aligned with the openings 96 in feed disk 94. The openings 100 lead to converging nozzles 104 which meet in the passageway 102. The four small arrows in FIG. 10 indicate the direction of flow of the four fuel channels. Because of the geometry of the fuel channels in nozzle disk 98, a substantially V-shaped spray of fuel exits the orifice disk as shown by the arrows 106 in FIG. 10.

While impinging jet atomizers having two, three and four channels have been described, the number of channels, their respective area ratios and their geometric layout may be adjusted for each application. In the embodiment of the invention shown in FIG. 1 and the disks shown in FIGS. 4, 6, 7 and 10, the nozzles in the respective feed disks converge in the fuel injector radial direction. However, it is also possible for the nozzles to converge in the fuel injector axial direction.

Figure 3:
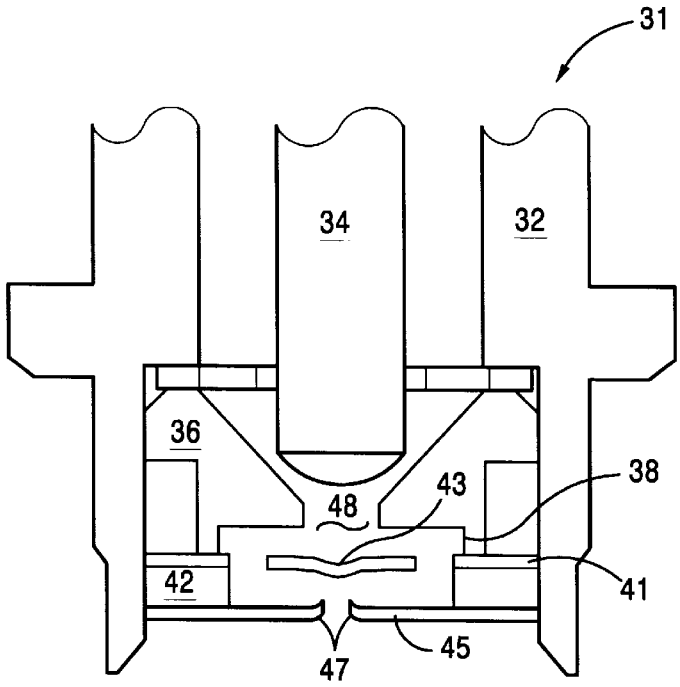
FIG. 3 is a cutaway side view of the bottom portion of a second embodiment of a fuel injector according to the present invention.

FIG. 3 is a cutaway side view of a second embodiment of a fuel injector 31 according to the present invention. In FIGS. 1 and 3, like reference numerals refer to like features. In FIG. 3, the feed disk 41 includes a downwardly displaced dimple 43. Also, the exit orifice disk 45 includes an upwardly displaced dimple 47. As a result of the dimple 43 in the feed disk 41 and/or the dimple 47 in the exit orifice disk 45, the nozzles in the nozzle disk 42 converge in the fuel injector axial direction. Using the axially converging nozzle of the dimpled feed disk 41 and the dimpled exit orifice disk 47 in combination with a radially converging nozzle as shown in any of FIGS. 4, 6, 7 and 10, it is possible to construct nozzles which converge both axially and radially.

Figure 11:
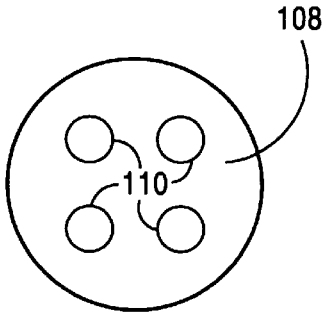
FIG. 11 is a top view of an exit orifice disk.

In FIGS. 1 and 3, it appears that the exit orifice disks 44, 45 define a single exit opening. However, the exit orifice disk may have more than one opening. As shown in FIG. 11, an exit orifice disk 108 may include four exit openings 110.

Flow metering in an ordinary injector is provided by the exit orifice disk, however, in an impinging jet injector according to the present invention, a combination of the nozzle disk and the exit orifice disk would meter the flow. As shown in FIG. 6, for example, as the nozzle channels 72, 72 are reduced in cross-sectional area, the flow velocity increases, but the friction loss (pressure drop) also increases. For fine atomization, the highest velocity flow in the nozzle channel would be desired (for a given flow rate), and the exit orifice disk would provide a "tweak" for flow adjustment. For a given flow rate, one injector application may require a 75% pressure drop across the nozzle disk, and 25% pressure drop across the exit orifice disk (yielding one level of atomization), while another injector application may require a 50%—50% pressure drop across the nozzle and exit orifice disks and a different level of atomization. Varying the pressure drops across the nozzle disk and the exit orifice disk may be done by adjusting the geometry of the nozzle disk and the exit orifice disk.

Figure 7:
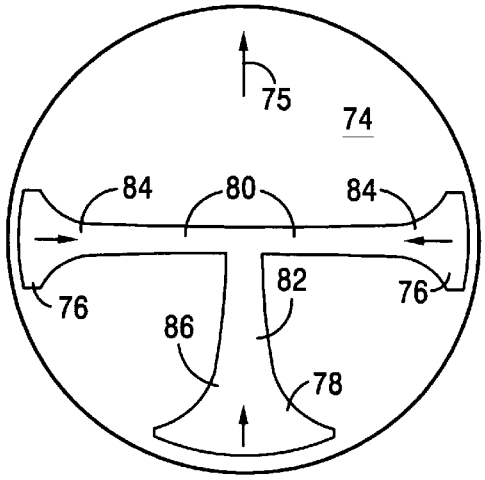
FIG. 7 is a top view of a nozzle disk.

Varied and unique spray patterns may be made by changing the area ratios, the convergence factors, and the locations of the jet channels, as shown in FIGS. 7 and 10. This allows the creation of spray patterns not achievable with conventional orifice disk technology, such as the "V" shaped spray pattern shown in FIG. 10, while still using an exit orifice disk with a single opening.

Several observations may be made. In general, for a given nozzle geometry, the average velocity through the nozzle will increase as the system pressure increases. Because kinetic energy is proportional to the velocity squared, increasing the system pressure should improve the operation of the invention. Further, there is very little velocity component in the axial direction, as compared to a standard injector. This implies that the spray velocity (penetration length) will be significantly decreased from a standard injector.

Another aspect of the present invention is a method of improving the atomization of fuel in fuel injectors. As shown in FIG. 1, for example, the method includes the steps of providing a fuel injector 30; adding fuel to the fuel injector 30; passing the fuel through the central opening 48 in the seat 36 of the fuel injector; separating the fuel into at least two channels; and directing the at least two channels of fuel towards one another such that the channels of fuel collide with each other.

In FIG. 1, the fuel is separated into channels using a feed disk 40 having at least two openings therein. The fuel channels are directed towards one another using the nozzle disk 42.

As shown in FIGS. 4, 6, 7 and 10, the fuel channels are directed through radially converging nozzles. The method of the invention further includes exiting the fuel from the fuel injector 30 through the opening 46.

As shown in FIG. 3, the fuel channels may also be directed through axially converging nozzles created by the dimples 43, 47 in the feed disk 41 and exit orifice disk 45, respectively.

While the invention has been disclosed with reference to certain preferred embodiments, numerous modifications, alterations and changes to the described embodiments are possible without departing from the spirit and scope of the invention, as defined in the appended claims and equivalents thereof.

What is claimed is:

1. A fuel injector for an internal combustion engine, comprised of:

an armature assembly including an injector needle reciprocable between a closed position and an open position;

a needle seat for receiving the injector needle in the closed position, the needle seat including a central opening therethrough wherein a bottom of the needle seat includes a counterbore having a diameter larger than a diameter of the central opening of the needle seat;

an exit orifice disk disposed downstream of the needle seat; and an impinging jet atomizer disposed upstream of the exit orifice disk, the impinging jet atomizer including a feed disk defining at least two openings, the feed disk disposed downstream from the counterbore and a nozzle disk disposed downstream of the feed disk, the nozzle disk including at least two openings aligned with the at least two openings in the feed disk, for receiving fuel from the feed disk, and a passageway connecting the opening in the nozzle disk such that at least two separate channels of fuel flow from the openings in the feed disk to the openings in the nozzle disk and through the passageway to impinge on one another.

2. The fuel injector of claim 1 wherein the passageway includes two nozzles converging from the openings in the nozzle disk to a center of the passageway.

3. The fuel injector of claim 2 wherein the two nozzles converge in the fuel injector axial direction.

4. The fuel injector of claim 2 wherein the two nozzles converge in the fuel injector radial direction.

5. The fuel injector of claim 1 wherein the feed disk defines three openings.

6. The fuel injector of claim 5 wherein the impinging jet atomizer includes a nozzle disk disposed downstream of the feed disk, the nozzle disk including three openings aligned with the three openings in the feed disk, for receiving fuel from the feed disk, and passageways connecting the openings in the nozzle disk such that three separate channels of fuel flow from the openings in the feed disk to the openings in the nozzle disk and through the passageways to impinge on one another.

7. The fuel injector of claim 6 wherein the passageways include three nozzles converging from the openings in the nozzle disk to an intersection of the passageways.

8. The fuel injector of claim 7 wherein the three nozzles converge in the fuel injector axial direction.

9. The fuel injector of claim 8 wherein the three nozzles converge in the fuel injector radial direction.

10. The fuel injector of claim 7 wherein the three nozzles converge in both the fuel injector axial and radial directions.

11. The fuel injector of claim 1 wherein the feed disk includes a downward dimple.

12. The fuel injector of claim 11 wherein the exit orifice disk includes an upward dimple.

13. The fuel injector of claim 2 wherein the two nozzles converge in both the fuel injector axial and radial directions.

14. The fuel injector of claim 1, wherein the exit orifice disk includes a single opening.

15. The fuel injector of claim 1, wherein the exit orifice disk includes a plurality of openings.

16. The fuel injector of claim 1 wherein the feed disk defines four openings.

17. The fuel injector of claim 16 wherein the impinging jet atomizer includes a nozzle disk disposed downstream of the feed disk, the nozzle disk including four openings aligned with the four openings in the feed disk, for receiving fuel from the feed disk, and passageways connecting the openings in the nozzle disk such that four separate channels of fuel flow from the openings in the feed disk to the openings in the nozzle disk and through the passageways to impinge on one another.

18. The fuel injector of claim 17 wherein the passageways include four nozzles converging from the openings in the nozzle disk to intersections of the passageways.

19. A method of improving atomization of fuel in fuel injectors comprising:

providing a fuel injector;

adding fuel to the fuel injector;

passing the fuel through a central opening in a seat of the fuel injector;

separating the fuel into at least two channels using a feed disk having at least two openings therein; and using a nozzle disk to direct the at least two channels of fuel towards one another such that the channels of fuel collide with each other.

20. The method of claim 19 wherein the fuel channels are directed through converging nozzles.

21. The method of claim 19 further comprising exiting the fuel from the fuel injector.

* * * * *